US011932444B2

(12) United States Patent
Frohwein

(10) Patent No.: US 11,932,444 B2
(45) Date of Patent: Mar. 19, 2024

(54) REUSABLE FOOD TRANSPORTATION DEVICE

(71) Applicant: Smart Container Holdings LLC, Orlando, FL (US)

(72) Inventor: Daniel M. Frohwein, Orlando, FL (US)

( * ) Notice: Subject to any disclaimer, the term of this patent is extended or adjusted under 35 U.S.C. 154(b) by 0 days.

(21) Appl. No.: 17/661,964

(22) Filed: May 4, 2022

(65) Prior Publication Data

US 2023/0356882 A1 Nov. 9, 2023

(51) Int. Cl.
*B65D 21/02* (2006.01)
*A45C 11/20* (2006.01)

(52) U.S. Cl.
CPC ..... *B65D 21/0201* (2013.01); *A45C 11/20* (2013.01)

(58) Field of Classification Search
CPC .. B65D 21/0201; B65D 21/0204; B65D 1/24; B65D 77/048; A45C 11/20; A61J 1/16
USPC ..... 220/23.2; 211/78; 222/142.3, 142.4, 222/142.5
See application file for complete search history.

(56) References Cited

U.S. PATENT DOCUMENTS 225,143 A * 3/1880 Kahler ..... A47G 19/24 220/253
1,977,092 A * 10/1934 Scurlock ..... A47G 23/08 D7/615
2,030,899 A * 2/1936 Scurlock ..... A47G 23/08 211/144
2,514,416 A * 7/1950 Plunkett ..... B65D 47/263 222/142.3
4,886,179 A 12/1989 Volk
6,131,772 A * 10/2000 Robbins ..... A47F 1/035 220/675
7,097,037 B1 * 8/2006 Keffeler ..... B65D 21/0202 206/532
7,156,226 B1 * 1/2007 Van Sickle ..... A47J 47/16 206/1.5
8,302,787 B2 * 11/2012 Tobey ..... A61J 1/16 211/77
2005/0072711 A1 * 4/2005 Yang ..... F25D 3/08 206/499
2008/0011697 A1 * 1/2008 Berg ..... A47B 49/00 211/10
2018/0057207 A1 * 3/2018 Maroofian ..... B65D 21/0206
(Continued)

FOREIGN PATENT DOCUMENTS

KR 20110003585 U 4/2011

*Primary Examiner* — Ernesto A Grano
*Assistant Examiner* — Symren K Sanghera
(74) *Attorney, Agent, or Firm* — Larson & Larson; Justin P. Miller; Frank Liebenow

(57) ABSTRACT

The reusable food transportation device, or food transportation system, includes a single hub that connects to a collection of containers. The hub is circular and the food containers are angular wedges projecting horizontally outward from the hub. Each food container includes a vessel and a lid. During transportation the hub, formed from an upper section and a lower section, compresses each lid against its respective vessel to prevent spillage of the food contained within. When the device arrives at its destination the upper section and the lower section of the hub are separated from each other. This removes the compressive force holding the lid and the vessel in place. The user may then remove the containers as they see fit.

18 Claims, 14 Drawing Sheets

(56) References Cited

U.S. PATENT DOCUMENTS

2021/0309416 A1* 10/2021 Grella ..... B25G 1/06
2022/0112010 A1* 4/2022 Darst ..... B65D 43/16

* cited by examiner

REUSABLE FOOD TRANSPORTATION DEVICE

FIELD

This invention relates to the field of food storage and more particularly to a device for transport of a selection of food containers, the containers being removable and reconfigurable.

BACKGROUND

A food package or storage container must serve many purposes, including physical protection, barrier protection, containment, portion control, convenience and security (tamper evidence). Additionally, a food container may provide visible information and marketing to the customer. There are an innumerable variety of containers designed to contain and transport food in the current art.

These containers are divided into two main groups; those that are destined to be single-use and disposable, and those designed for reuse.

Disposable containers are generally associated with take-out and food-delivery services, as well as adapted for transporting smaller quantities of prepared foods or ingredients from grocery stores, specialty food outlets, and the like. They are also utilized to provide left-over food to patrons from dine-in establishments. They may be recyclable but are generally single-use items. They are found in a variety of rectangular and circular shapes and materials ranging from aluminum foil tins with flat cardboard lids, to plastic container and lid combinations, paperboard boxes, delicatessen containers, styrofoam clamshell containers, even the ubiquitous and iconic chinese food takeout box.

Alternatively, reusable food containers are customarily for personal use and have found acceptance in daily preparation, transportation, and consumption of food at school, work or during other outings. Like their disposable counterparts, they are generally round or rectangular in shape, and may contain internal partitions to segregate food contents. They are constructed generally from food-grade plastic materials and glass. These consumer goods come individually and sometimes in coordinated sets of varying sizes.

An opportunity and a need exists to unify these two disparate aspects of food transport and consumption with an improved, multipurpose, reusable food container device that is optimized for both personal and commercial use.

The rise of appealing cellphone app-based food delivery services have allowed the concept of food delivery to progress beyond the customary neighborhood pizza parlor, sandwich shop, and chinese food offerings. Now, restaurant-quality cuisine of virtually any type is available at the tap of a button. As an industry, food delivery apps were already enjoying a robust yearly growth, and this has been increased further by the recent viral pandemic. With the increase in food delivery, which is poised to remain a permanent fixture in dining, there has been a proportionate increase in the utilization of takeout food containers. Such containers are single use, and while some may be recyclable, they are not reliably so. Single-use plastic bags, and food containers are two of the top four plastic pollutants found in the oceans today. It is self-evident that there is a large need to develop a robust, reusable food transport and delivery system. Such a container system would render single-use plastic food containers, and the bags they come in, obsolete. Once the food is consumed by the receiving party, the container system would then be returned to a receiving source for sanitation and redeployment.

For the food delivery customer, the customer enjoys delivery in hygienic, robust, and tamper-evident containers which allow for segregation and temperature maintenance, as well as direct food consumption. Consistent portioning in the containers allows for nutritional information to be gleaned, and therefore meaningful relative comparisons made between foodstuffs to be obtained.

Restaurants who participate in providing their menu items in the container derive the benefit of eliminating the need to purchase takeout containers, while reutilizing facilities and equipment previously vacated by the downturn of in-house dining. Additionally, food proprietors are able to accurately and reliably portion take-out servings, allowing for improved budgeting for raw food ingredient needs, thereby reducing waste. Restaurants will have access to customers who are participating in the initiative to reduce waste by preferably patronizing establishments who utilize single-use food containers. Restaurants may also develop new menu options and preparations to take advantage of the container sizes and configurations, essentially designing their menu options 'from the container up.'

Outside of food delivery services, the container can find acceptance in many other commercial environments and industries, including hotels and resorts, vacation theme parks, convention centers, cruise ships, fast-casual food establishments, cafeterias, food courts, schools, the airline industry, senior living facilities, hospitals, and other institutional settings.

SUMMARY

The reconfigurable and reusable food transportation device, or food transportation system, includes a central hub that connects to a collection of containers. The hub is circular and the food containers are angular wedges projecting horizontally outward from the hub. Each food container includes a vessel and a lid.

During transportation the hub, formed from an upper section and a lower section, acts to compress each lid against its respective vessel. This prevents spillage of the food contained within.

When the device arrives at its destination the upper section and the lower section of the hub are separated from each other. This removes the compressive force holding the lid and the vessel in place. The user may then remove the containers as they see fit.

During transportation the containers are aligned to the hub using compression and alignment rings, the alignment rings being a combination of grooves and ribs. Each rib is a protruding circular ring, the groove its mating depression.

For example, the hub upper section and hub lower section can include a protruding rib or recessed groove, and the lid and vessel of each container can include a corresponding groove or rib, respectively. In combination, the groove and rib create an alignment ring.

The function of the alignment ring is to prevent containers from sliding outward, or disengaging from the hub, during transportation.

The result is that the central hub can accommodate containers of varying sizes, so long as the containers do not total more than 360 degrees in angular size.

In the preferred embodiment the central hub is circular with the ribs and grooves correspondingly circular. By virtue of being circular, the containers can be affixed at any point on the central hub. There is no indexing, or requirement that the containers sit at certain angular positions.

The hub top and bottom, or upper section and lower section, compress the food containers to avoid spillage. The upper section of the hub optionally includes a deployable upper handle to allow the user to carry the device for easy transportation.

Optionally included in the top section of the hub is a knob with thumb depressions. The knob helps the user to actuate the top section of the hub with respect to the bottom section of the hub to rotate the twist lock, or threaded hub interface.

The preferred form factor of the assembled food transport device is circular, however other shapes are anticipated, such as square, octagon, pentagon, and so forth. The distal end of individual containers would change conformation in these instances.

In the preferred circular embodiment, the individual containers are shaped as wedges. A variety of sizes may be used, referred to by the angular space occupied by each container. For example, 60 degrees, 90 degrees, 120 degrees, and 180 degrees may be envisioned.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
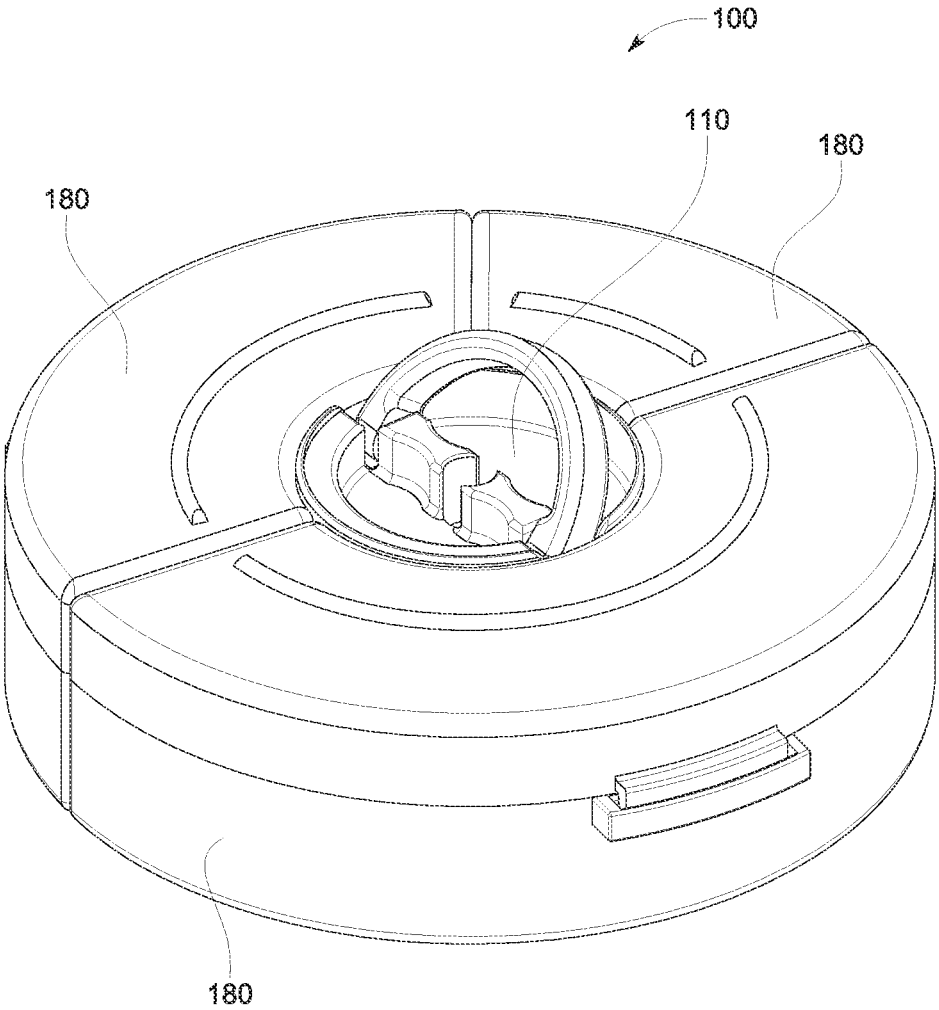
FIG. 1 illustrates a first isometric view of the food transportation system.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first isometric view of the food transportation system is shown.

The food transportation system 100 is shown formed from a hub no and multiple containers 180.

Figure 2:
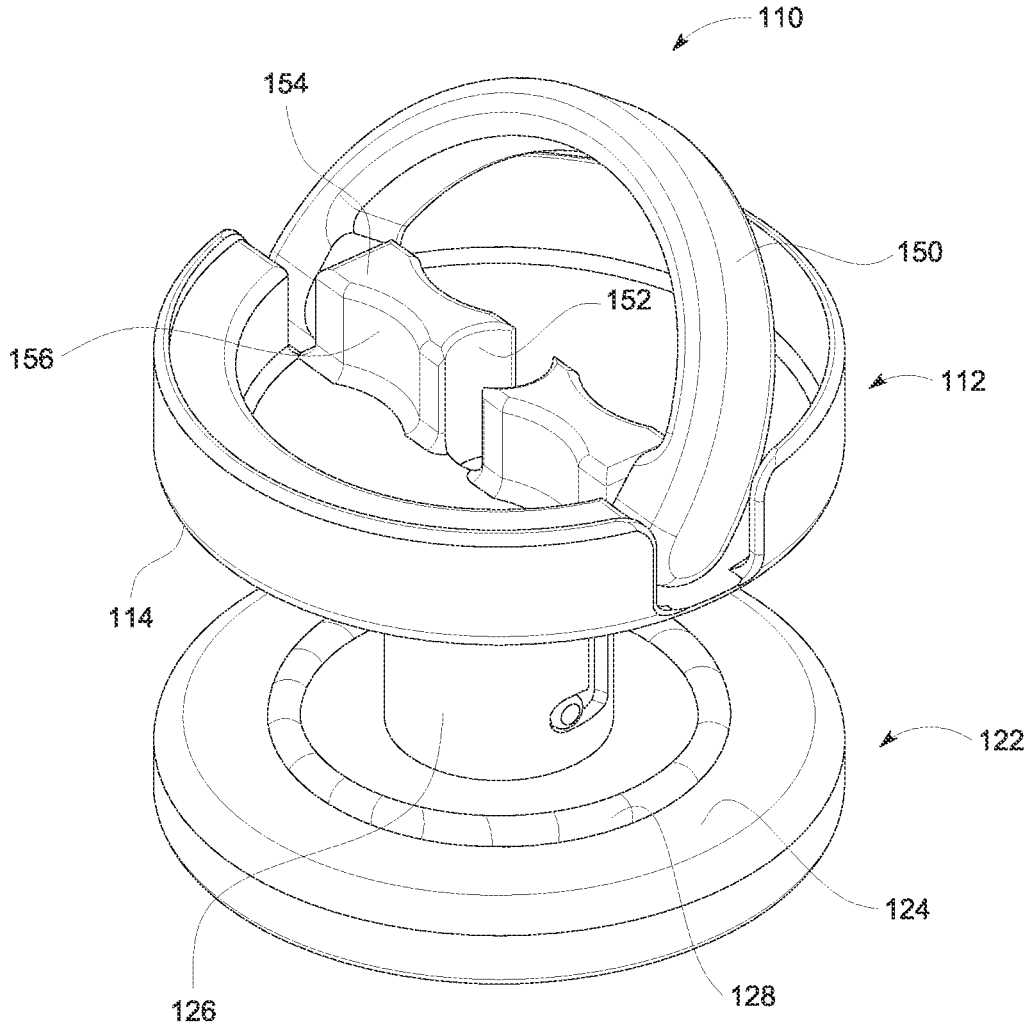
FIG. 2 illustrates a first isometric view of the hub of the food transportation system.
Figure 3:
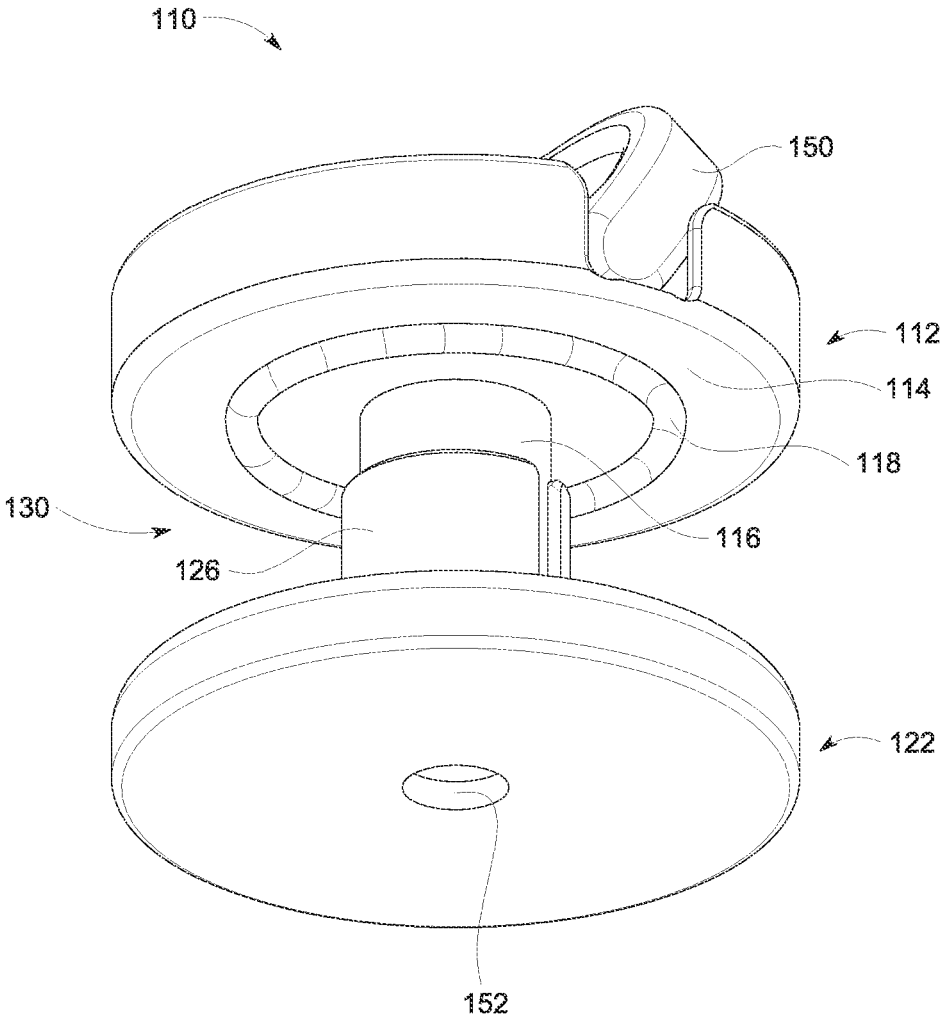
FIG. 3 illustrates a second isometric view of the hub of the food transportation system.

Referring to FIGS. 2 and 3, first and second isometric views of the hub of the food transportation system are shown.

The hub 110 is shown formed from hub upper section 112 with upper plate 114, upper cylinder 116, and upper rib 118.

Also shown is hub lower section 122 including lower plate 124.

To align the food containers 180 (see FIG. 1), also shown is lower rib 128.

The hub lower section 122 includes an upwardly projecting lower cylinder 126.

The hub 110 optionally includes a handle 150. An optional alignment opening 152 is an entrance to a hole that passes completely through the hub 110. This allows multiple hubs to be stacked, using a central rod to maintain alignment.

A central knob 154 with thumb depressions 156 helps the user to rotate the hub upper section 112 with respect to the hub lower section 122, allowing the user to engage and disengage the two sections from each other.

Figure 4:
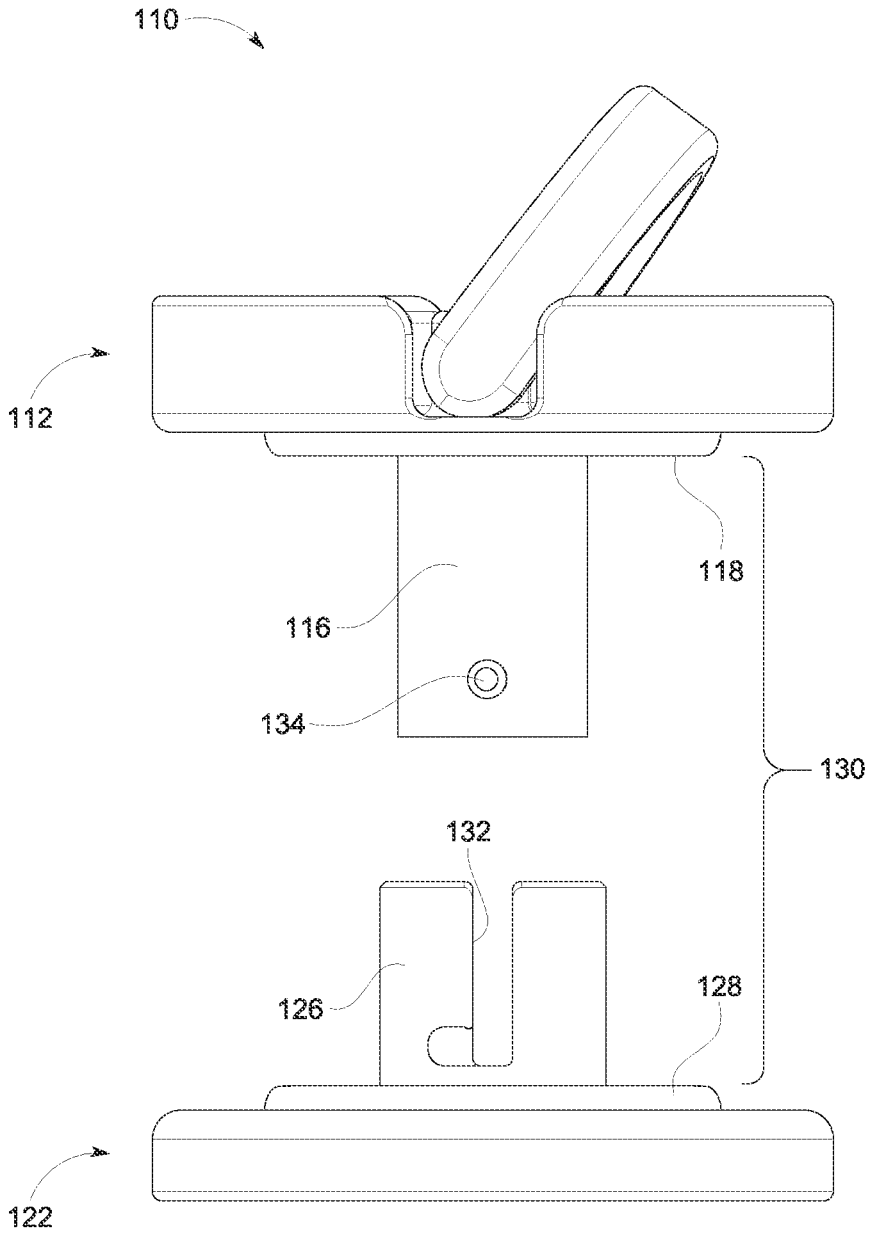
FIG. 4 illustrates a side and partially exploded view of the hub of the food transportation system.

Referring to FIG. 4, a side and partially exploded view of the hub of the food transportation system is shown.

In this embodiment, the hub upper section 112 and hub lower section 122 engage and disengage with each other using a twist lock mechanism, or releasable locking mechanism 130.

The releasable locking mechanism 130 is formed from the upper cylinder 116 and lower cylinder 126, which slide together. A slot 132 guides and locks a pin 134, with final rotation causing locking of the pin 134 within the slot 132.

The releasable locking mechanism 130 has a locked position and an unlocked position.

Figure 5:
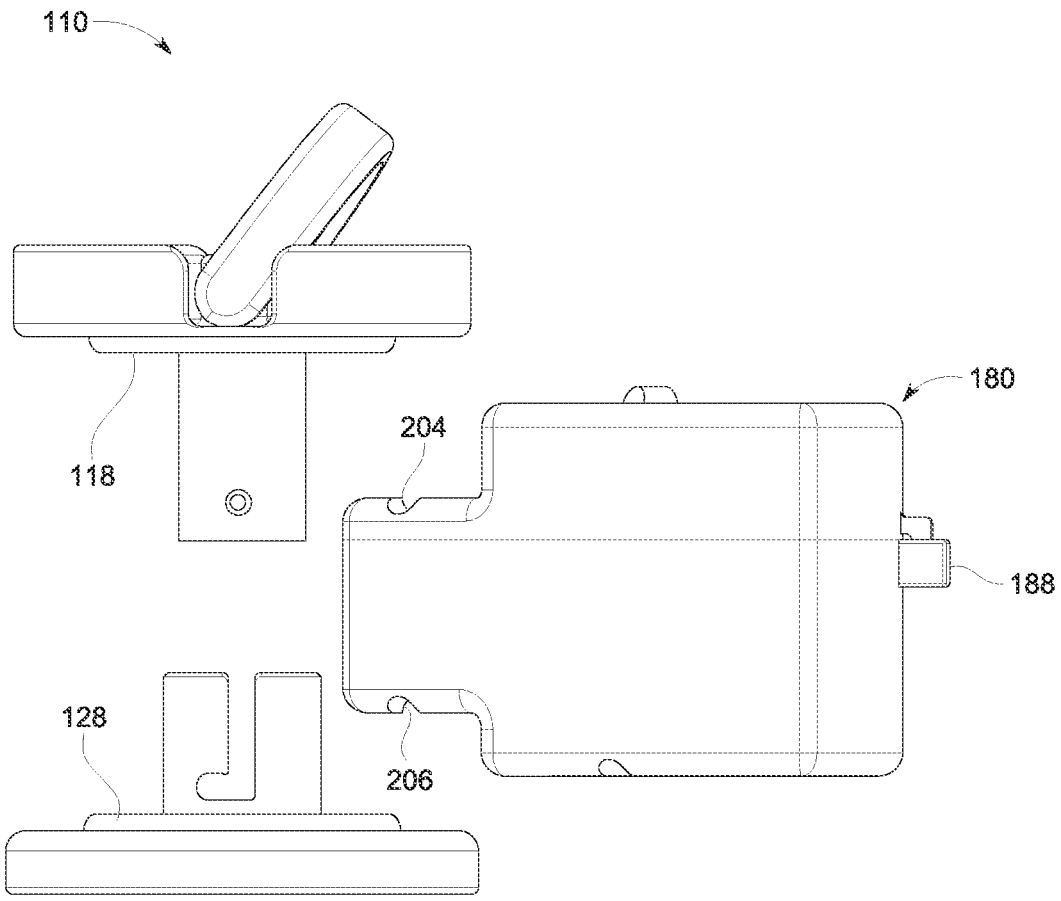
FIG. 5 illustrates a side and partially exploded view of the hub and a single container of the food transportation system.

In the locked position, the hub upper section 112 and hub lower section 122 are held together, compressing a food container 180 (see FIG. 5).

In the unlocked position, the hub upper section 112 and hub lower section 122 are disengaged from each other, allowing the user to remove the hub upper section 112, and correspondingly remove the food container 180 (see FIG. 5).

Figure 6:
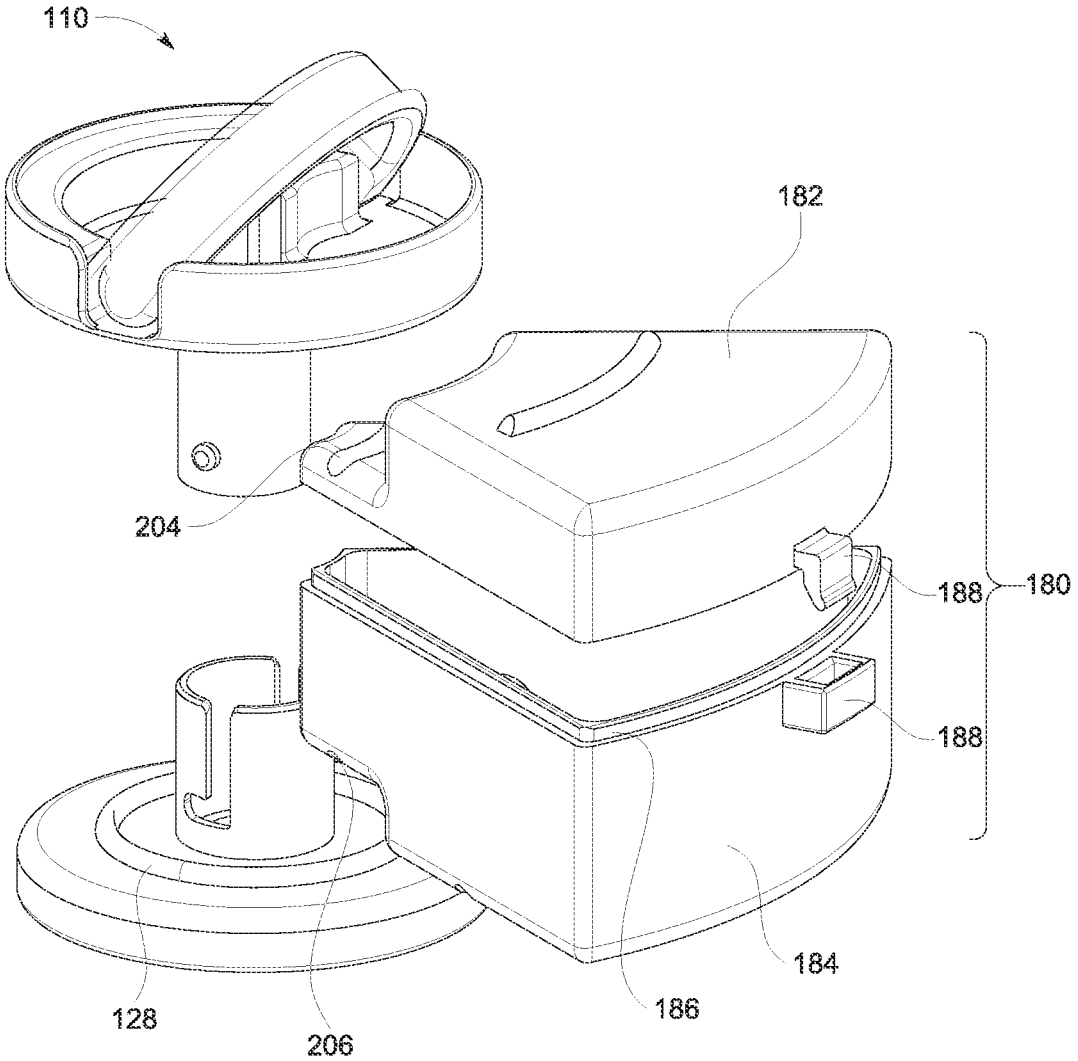
FIG. 6 illustrates an isometric and partially exploded view of the hub and a single container of the food transportation system.

Referring to FIGS. 5 and 6, partially exploded side and isometric views of the hub and a single container of the food transportation system are shown.

To align the food containers 180 with the hub 110, the upper rib 118 and lower rib 128 interface with the lid groove 204 and vessel groove 206, respectively.

The combination of the upper rib 118 in lid groove 204, and/or the combination of the lower rib 128 and vessel groove 206, are referred to as an alignment rings. The alignment ring is considered the confluence of grooves and ribs, with a circular shape that aligns the hub 110 with the one or more food containers 180.

When the hub 110 is compressed against a food container 180, the food container 180 cannot move outward with respect to the hub 110. This prevents the food containers from disengaging from the hub 110. The vertical compression holds the food containers 180 closed and prevents rotation and dislodgement of the food container 180 with respect to the hub 110.

Each container 180 is formed from a lid 182 and vessel 184 that meet at a junction 186. The lid 182 and vessel 184 optionally include a hinge 188 that allows the user to rotate the lid 182 up and away from the vessel 184.

Figure 7:
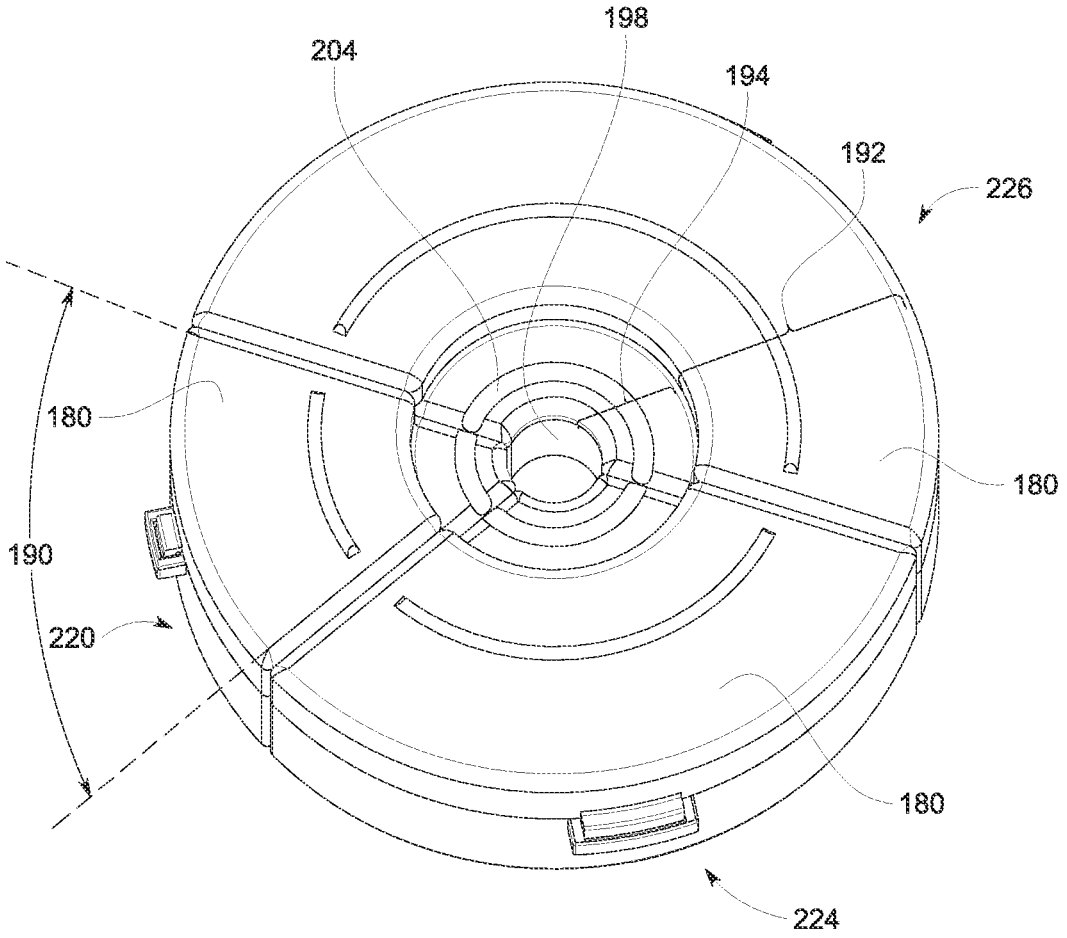
FIG. 7 illustrates an isometric view of the containers of the food transportation system.

Referring to FIG. 7, an isometric view of the containers of the food transportation system is shown.

Each container 180 is divided into a main section 192 and a mating section 194.

Main section 192 is where the bulk of the food is held. Mating section 194 is the part interfaced with by the hub 110 (see FIG. 1).

The hub 110 passes through central hole 198, the space left in the center between any mounted containers 180.

Each container 180 occupies a container angle 190. Shown are a 60-degree container 220, a 120-degree container 224, and a 180-degree container 226.

The alignment ring, shown here as lid groove 204, is created by the combination of multiple containers 180 placed such that they form a complete circle.

Figure 8:
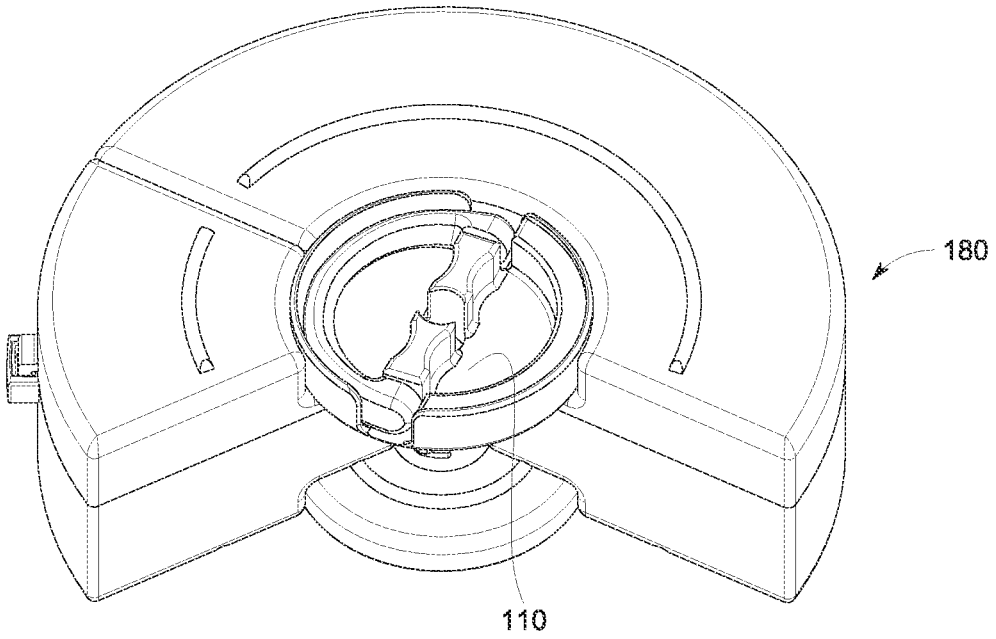
FIG. 8 illustrates a second isometric view of the food transportation system.
Figure 9:
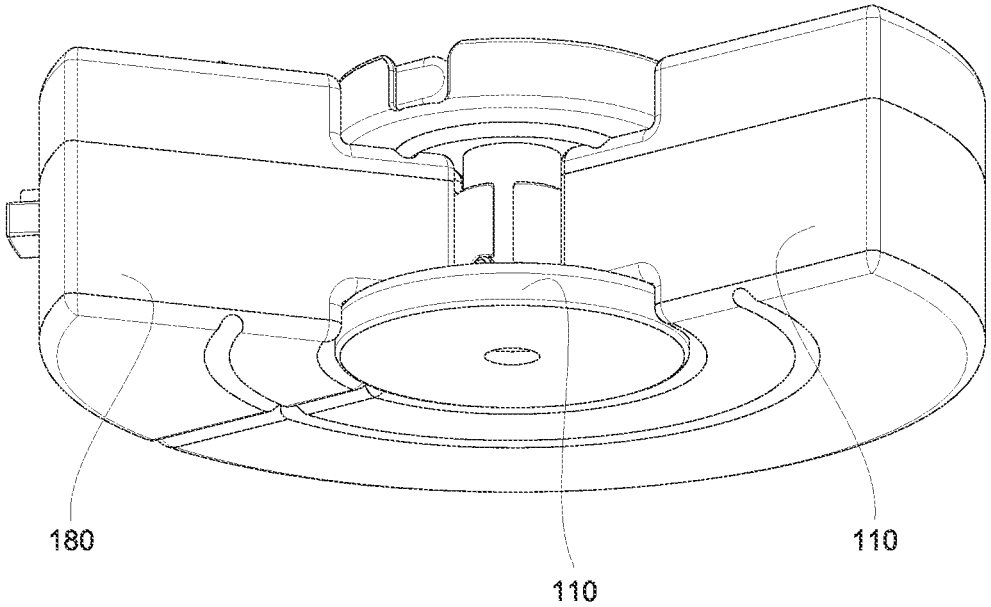
FIG. 9 illustrates a third isometric view of the food transportation system.

Referring to FIGS. 8 and 9, second and third isometric views of the food transportation system are shown.

The food transportation system 100 is shown with fewer containers than maximum capacity. The compression of the hub 110 against the containers 180 holds the containers 180 in place, even with a section of the hub 110 left empty.

Figure 10:
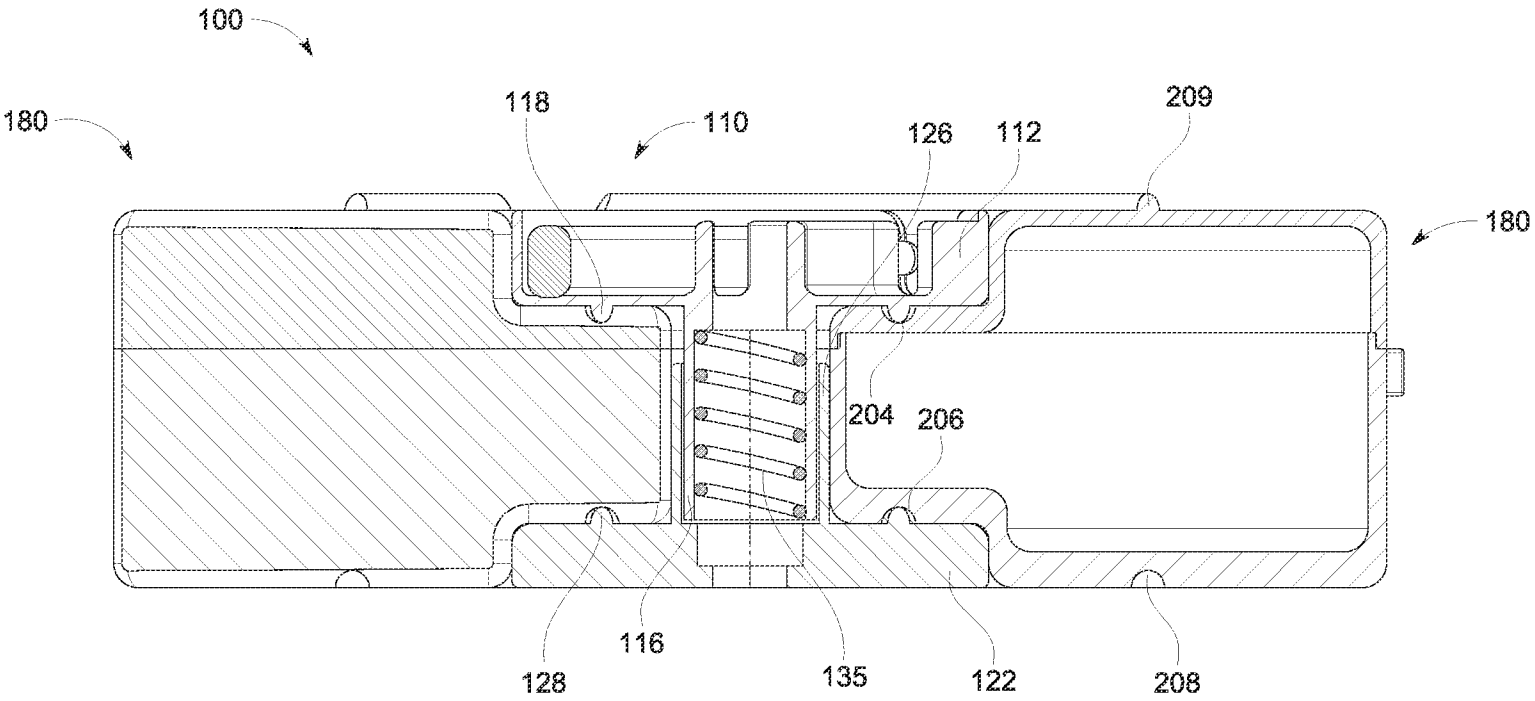
FIG. 10 illustrates a cross-section of the food transportation system.

Referring to FIG. 10, a cross-section of the food transportation system is shown.

The hub 110 is shown holding food containers 180. The upper rib 118 interfaces with the lid groove 204. The lower rib 128 interfaces with the vessel groove 206.

The spring 135 is visible nested within the upper cylinder 116 and lower cylinder 126. The spring is compressed as the hub upper section 112 is pushed toward the hub lower section 122. When the release of a locking mechanism 130 (see FIG. 4), the spring 135 creates a popping action, pushing hub upper section 112 away from hub lower section 122.

In this cross-sectional view, it is apparent that the bottom of the food containers 180 shares the same plane as the bottom of the hub 110.

The result is that the food transportation system is stable and sturdy because the weight of the entire device is supported across the bottom of both the food containers and the hub.

The stacking groove 208 and stacking rib 209 interact with additional food transportation systems 100 placed above, or below, each other. The result of the interaction between the stacking grooves 208 and stacking ribs 209 is to align multiple food transportation systems 100, creating a common central axis.

By allowing the stacking groups 208 and stacking ribs 209 to interact with each other, the multiple systems 100 are aligned.

Figure 11:
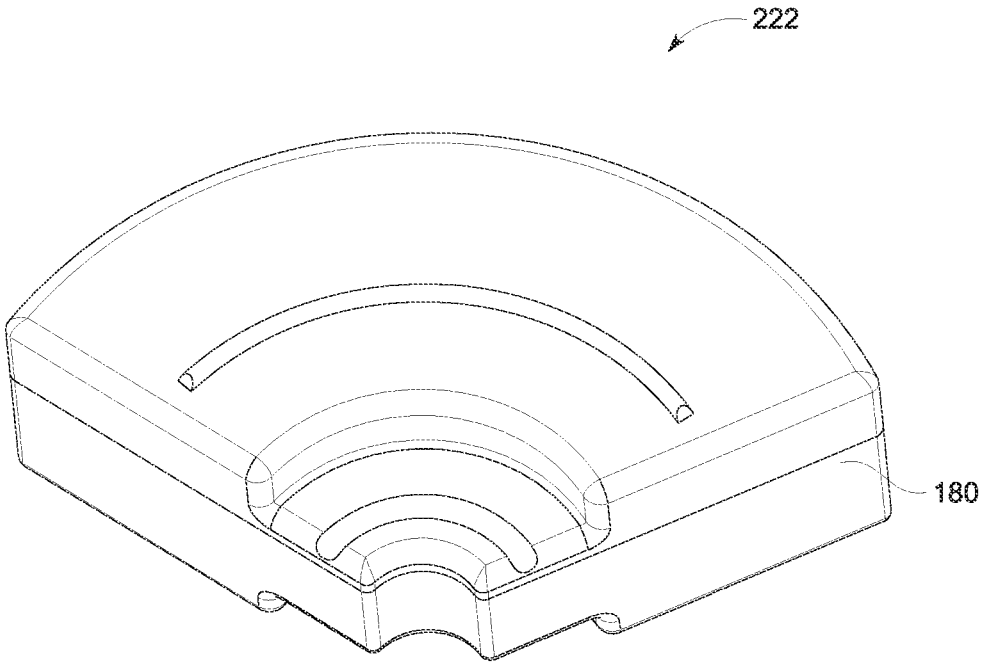
FIG. 11 illustrates an isometric view of a 90-degree container of the food transportation system.

Referring to FIG. 11, an isometric view of a 90-degree container of the food transportation system is shown.

Container 180 is shown as a 90-degree container 222.

Figure 12:
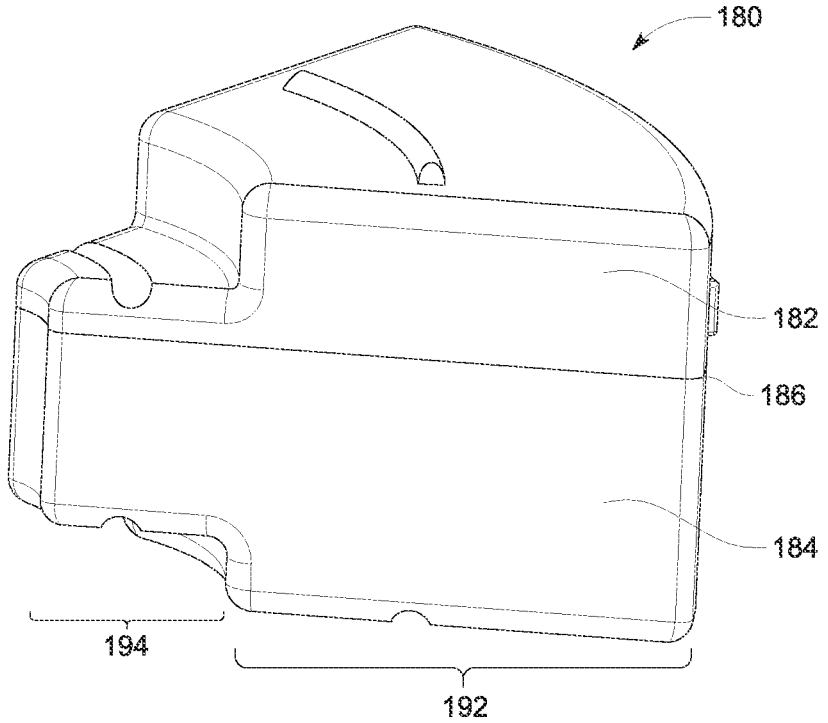
FIG. 12 illustrates an isometric view of the first embodiment of the containers of the food transportation system.
Figure 13:
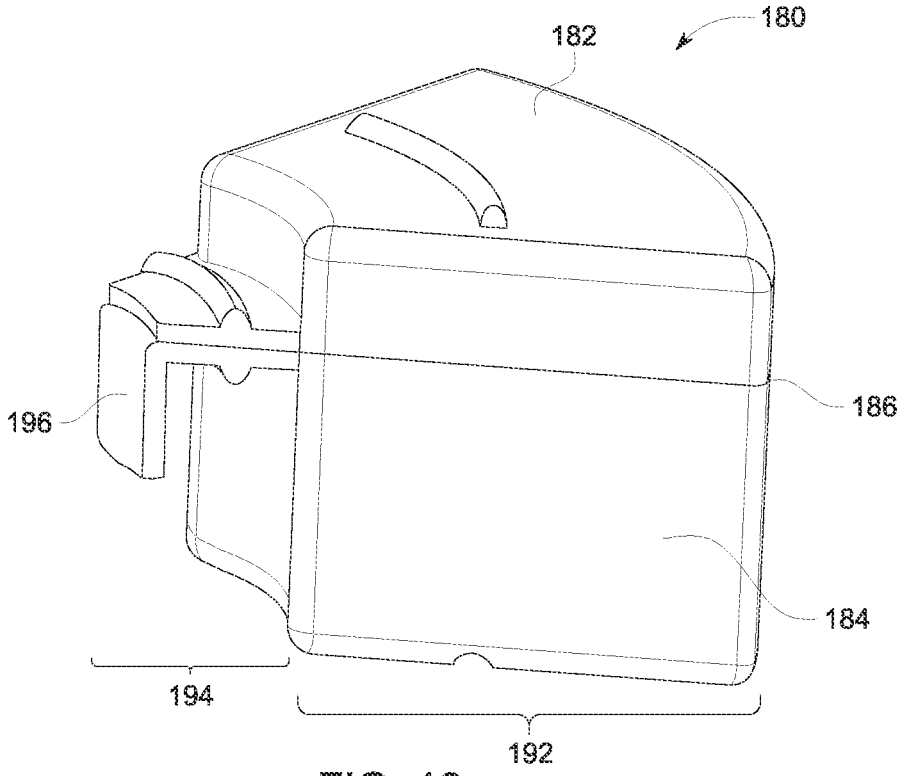
FIG. 13 illustrates an isometric view of the second embodiment of the containers of the food transportation system.

Referring to FIGS. 12 and 13, isometric views of the first and second embodiments of the containers of the food transportation system are shown.

Each container 180 includes a lid 182 and vessel 184 that meet at a junction 186. The main sections 192 are substantially identical across the first and second embodiments.

The difference between the two embodiments can be seen by comparing the mating sections 194.

The first embodiment, shown in FIG. 12, can store food in the mating section 194. In contrast, the second embodiment, shown in FIG. 13, does not store food within the mating section 194. Instead, the mating section 194 of the vessel 184 is moved upward. An optional retaining tab 196 is created to allow the user to grip the container 180 for efficient dispensing.

Figure 14:
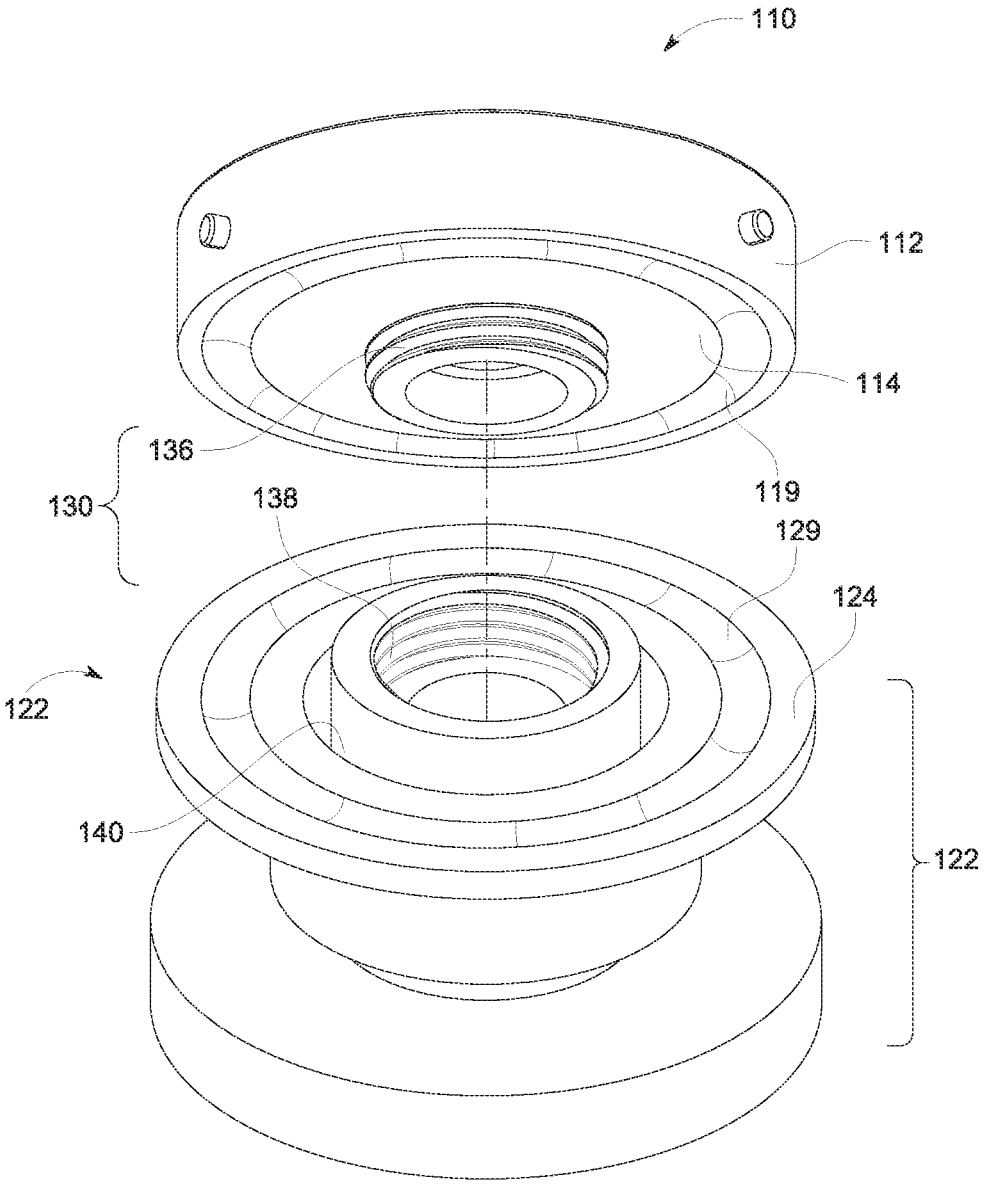
FIG. 14 illustrates a first isometric view of a second embodiment of the hub of the food transportation system.

Referring to FIG. 14, a first isometric view of a second embodiment of the hub of the food transportation system is shown.

The hub 110 again includes a hub upper section 112, upper plate 114, hub lower section 122, upper groove 119, and lower groove 129. In the second embodiment of the hub, the hub upper and lower sections contain grooves as opposed to ribs.

Regarding the use of grooves or ribs, the hub and food container can each be formed with either grooves or ribs, so long as the opposing surface uses the opposite. For example, the food container can include upward-facing ribs and downward-facing grooves with the mating hub services having the opposite. Alternative arrangements that mix-and-match grooves and ribs are anticipated. The goal is alignment by mating a groove and a rib, without requiring the hub or the food container to have grooves or ribs specifically.

In this second embodiment, the hub upper section 112 attaches to the hub lower section 122 via a male-threaded protrusion 136 and a female-threaded recess 138.

The releasable locking mechanism 130 of the second embodiment is the combination of a male-threaded protrusion 136 and a female-threaded recess 138.

Figure 15:
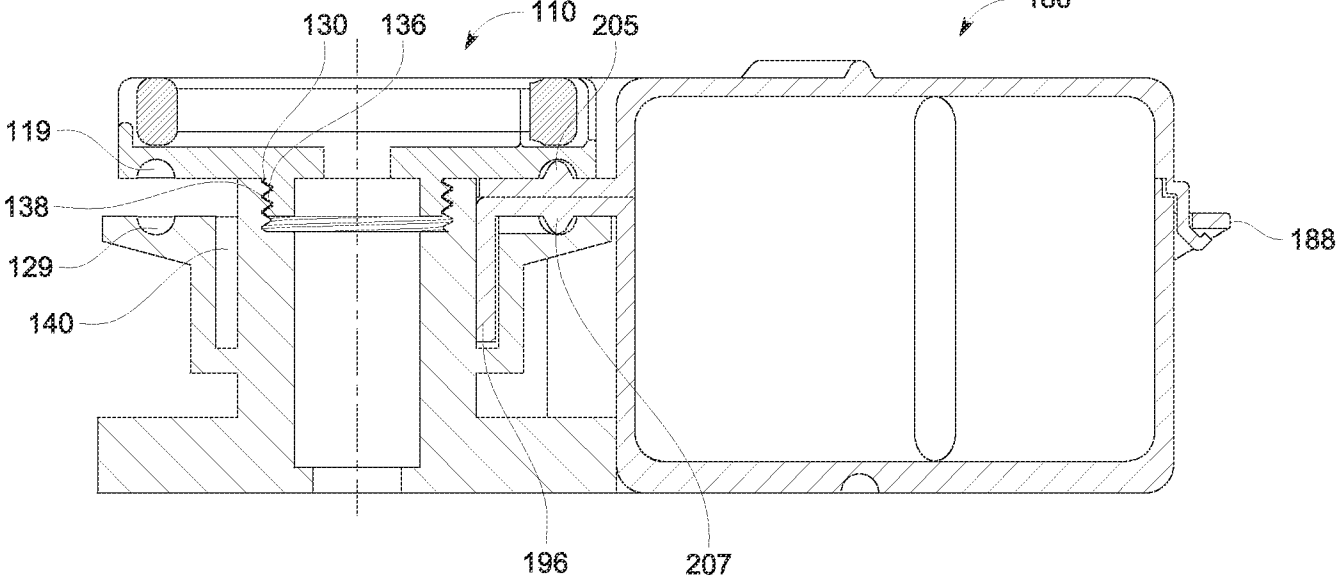
FIG. 15 illustrates a cross-section of the second embodiment hub and a container of the food transportation system.

Referring to FIG. 15, a cross-section of the second embodiment hub and container of the food transportation system is shown.

The hub 110 is shown holding food container 180. The upper groove 119 interfaces with the lid rib 205. The lower groove 129 interfaces with the vessel rib 207.

The retaining tab 196 sits within the tab gap 140.

The releasable locking mechanism 130 of the second embodiment is the combination of a male-threaded protrusion 136 and a female-threaded recess 138.

In this cross-sectional view, it is apparent that the bottom of the food containers 180 shares the same plane as the bottom of the hub 110.

Again shown is hinge 188.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely an exemplary and explanatory embodiment thereof. It is the intention of the following claims to encompass and include such changes.

What is claimed is:

1. A device for transportation of a food comprising:

a first food container;

the first container having a first container lower surface;

a second food container;

the second container having a second container lower surface;

a central circular hub;

the central circular hub having a locked position and an unlocked position;

the central circular hub compressing the first food container and the second food container when in the locked position;

the central circular hub releasing the first food container and the second food container when in the unlocked position;

the central circular hub having a central hub lower surface;

the first container lower surface coplanar with the central hub lower surface;

whereby a user places the central circular hub in a locked position for transportation of the first food container and the second food container, and the user places the central circular hub into the unlocked position for access to the food within the first food container and the second food container.

2. The device for the transportation of food of claim 1, further comprising:

the central circular hub formed from an upper section and a lower section;

the upper section and the lower section connected by a releasable locking mechanism;

the releasable locking mechanism operable by a user to move the central circular hub from a first position where the central circular hub compresses the first food container and the second food container, and second position where the central circular hub releases the first food container and the second food container;

whereby the user chooses between the first position and the second position of the releasable locking mechanism depending upon whether the device is to be transported or its contents accessed.

3. The device for the transportation of food of claim 2, further comprising:

a spring;

the spring causing the upper section and the lower section to move away from each other when the releasable locking mechanism is moved to the unlocked position.

4. The device for the transportation of food of claim 1, further comprising:

an alignment ring;

the alignment ring setting a distance from a center of the central circular hub with respect to the first food container.

5. The device for the transportation of food of claim 2, further comprising:

an alignment ring;

the alignment ring setting a distance from a center of the central circular hub with respect to the first food container.

6. The device for the transportation of food of claim 1, further comprising:

a circular rib protruding from the central circular hub;

a groove recessed into the first food container;

the circular rib fitting into the groove, setting a position of the first food container with respect to the central circular hub.

7. The device for the transportation of food of claim 1, further comprising:

a circular groove recessed into the central circular hub;

a rib protruding from the first food container;

the rib fitting into the circular groove, setting a position of the first food container with respect to the central circular hub.

8. The device for the transportation of food of claim 1, wherein:

the first food container has a first wall and a second wall;

the first wall forming an angle of 60, 90, 120, or 180 degrees with respect to the second wall;

whereby the user may select a size of the first food container based upon what is to be stored, and the size of any additional food containers to be affixed to the central circular hub.

9. A portable device for transportation of food, the portable device comprising:

a central hub;

the central hub formed from a hub upper section and a hub lower section;

the hub upper section and the hub lower section affixed to each other via a releasable locking mechanism;

the releasable locking mechanism having an open position and a closed position;

a food container;

the food container formed from a lid and a base;

the food container including a main section and a mating section;

the mating section interacting with the hub upper section and the hub lower section to hold the food container to the central hub;

a spring;

the spring causing the hub upper section and the hub lower section to move away from each other when the releasable locking mechanism is moved to the open position;

wherein when the releasable locking mechanism is in the open position, the lid of the food container is removable from the base;

wherein when the releasable locking mechanism is in the closed position, the lid of the food container is not removable from the base;

whereby a user may choose a position of the releasable locking mechanism depending upon whether the user wants to transport the food container or to access contents of the food container.

10. The portable device for the transportation of food of claim 9, further comprising:

an alignment ring;

the alignment ring setting a distance from a center of the central hub with respect to the food container.

11. The portable device for the transportation of food of claim 9, further comprising:

a circular rib protruding from the hub upper section of the central hub;

a groove recessed into the food container;

the circular rib fitting into the groove, setting a position of the food container with respect to the central hub.

12. The portable device for the transportation of food of claim 9, further comprising:

a circular groove recessed into the hub upper section of the central hub;

a rib protruding from the food container;

the rib fitting into the circular groove, setting a position of the food container with respect to the central hub.

13. The portable device for the transportation of food of claim 9, wherein:

the food container has a first wall and a second wall;

the first wall forming an angle of 60, 90, 120, or 180 degrees with respect to the second wall;

whereby the user may select a size of the food container based upon contents to be stored, and the size of any additional food containers to be affixed to the central hub.

14. A portable device to transport food containers of multiple sizes, the portable device comprising:

a hub formed from an upper section and a lower section;

the upper section and lower section interacting with each other via a releasable locking mechanism;

the lower section of the hub having a hub lower surface;

a food container;

the food container having a wedge shape with a tip and a base;

the tip of the food container interacting with the hub, allowing the hub to fasten to the food container;

the food container having a food container lower surface;

the hub lower surface coplanar with the food container lower surface;

a circular groove recessed into the upper section of the hub;

a rib protruding from the food container;

the rib fitting into the circular groove, setting a position of the food container with respect to the hub;

whereby a user can choose where to fix the food container to the hub, including placing the food container in a position to balance a second food container.

15. The portable device to transport food containers of multiple sizes of claim 14, further comprising:

a spring;

the spring causing the upper section and the lower section to move away from each other when the releasable locking mechanism is unlocked.

16. The portable device to transport food containers of multiple sizes of claim 14, further comprising:

an alignment ring;

the alignment ring setting a distance from a center of the hub with respect to the food container.

17. The portable device to transport food containers of multiple sizes of claim 14, further comprising:

a circular rib protruding from the upper section of the hub;

a groove recessed into the food container;

the circular rib fitting into the groove, setting a position of the food container with respect to the hub.

18. The portable device to transport food containers of multiple sizes of claim 14, wherein:

the food container has a first wall and a second wall;

the first wall forming an angle of 60, 90, 120, or 180 degrees with respect to the second wall;

whereby the user may select a size of the food container based upon contents to be stored, and the size of any additional food containers to be affixed to the hub.

* * * * *